US007318025B2

(12) United States Patent
Fischer et al.

(10) Patent No.: US 7,318,025 B2
(45) Date of Patent: Jan. 8, 2008

(54) METHOD FOR IMPROVING SPEECH QUALITY IN SPEECH TRANSMISSION TASKS

(75) Inventors: Alexander Kyrill Fischer, Griesheim (DE); Christoph Erdmann, Aachen (DE)

(73) Assignee: Deutsche Telekom AG, Bonn (DE)

( * ) Notice: Subject to any disclaimer, the term of this patent is extended or adjusted under 35 U.S.C. 154(b) by 875 days.

(21) Appl. No.: 10/258,023

(22) PCT Filed: Mar. 8, 2001

(86) PCT No.: PCT/EP01/02603

§ 371 (c)(1),
(2), (4) Date: Oct. 18, 2002

(87) PCT Pub. No.: WO01/84541

PCT Pub. Date: Nov. 8, 2001

(65) Prior Publication Data

US 2003/0105626 A1 Jun. 5, 2003

(30) Foreign Application Priority Data

Apr. 28, 2000 (DE) ..... 100 20 863

(51) Int. Cl.
*G10L 19/14* (2006.01)

(52) U.S. Cl. ..... 704/225; 704/228

(58) Field of Classification Search ..... None
See application file for complete search history.

(56) References Cited

U.S. PATENT DOCUMENTS 3,976,863 A * 8/1976 Engel ..... 708/306
4,133,976 A 1/1979 Atal et al. ..... 179/1 P
4,185,168 A * 1/1980 Graupe et al. ..... 381/318
5,089,818 A 2/1992 Mahieux et al. ..... 341/76
5,459,814 A 10/1995 Gupta et al. ..... 395/2.42
5,579,431 A 11/1996 Reaves ..... 395/2.23
5,839,101 A * 11/1998 Vahatalo et al. ..... 704/226
6,334,105 B1 * 12/2001 Ehara ..... 704/258
6,374,211 B2 4/2002 Stegmann et al. ..... 704/211

(Continued)

FOREIGN PATENT DOCUMENTS

DE 690 17 074 11/1990

(Continued)

OTHER PUBLICATIONS

R. Hagen et al. "An 8 KBITS/S Acelp Coder With Improved Background Noise Performance"; Mar. 1999; pp. 25-28 in "Audio and Visual Research Ericsson Radio Systems AB".

(Continued)

*Primary Examiner*—David D. Knepper
(74) *Attorney, Agent, or Firm*—Darby & Darby

(57) ABSTRACT

A method for calculating the amplication factor, which co-determines the volume, for a speech signal transmitted in encoded form includes dividing the speech signal into short temporal signal segments. The individual signal segments are encoded and transmitted separately from each other, and the amplication factor for each signal segment is calculated, transmitted and used by the decoder to reconstruct the signal. The amplication factor is determined by minimizing the value $E(g_opt2)=(1-a)*f_1(g_opt2)+a*f_2(g_opt2)$, the weighting factor a being determined taking into account both the periodicity and the stationarity of the encoded speech signal.

17 Claims, 1 Drawing Sheet

U.S. PATENT DOCUMENTS

| | | | | |
|---|---|---|---|---|
| 6,427,134 | B1 | 7/2002 | Garner et al. | 704/233 |
| 6,484,137 | B1 * | 11/2002 | Taniguchi et al. | 704/211 |

FOREIGN PATENT DOCUMENTS

| | | |
|---|---|---|
| DE | 40 20 633 | 1/1992 |
| DE | 694 20 027 | 8/1994 |
| DE | 19722705 | 7/1998 |
| DE | 197 16 862 | 10/1998 |
| DE | 69420200 | 8/1999 |
| DE | 69421501 | 11/1999 |
| DE | 69421143 | 5/2000 |
| DE | 69421498 | 7/2000 |
| EP | 0 397 564 | 11/1990 |
| EP | 0642129 | 3/1995 |
| EP | 0653091 | 5/1995 |
| EP | 0 683 916 | 11/1995 |
| EP | 0631274 | 8/1999 |
| EP | 0655161 | 11/1999 |
| WO | WO98/01847 | 1/1998 |
| WO | 0013174 | 3/2000 |

OTHER PUBLICATIONS

N.R. Garner et al.: "Robust noise detection for speech detection and enhancement", Electronics Letters, IEE Stevenage, GB, 13th Feb. 1997, vol. 33, No. 4, pp. 270-271.

I.D. LEE et al.: "A voice activity detection algorithm for communication systems with dynamically varying background acoustic noise", Ottawa, Canada, May 18-21, 1998, New York, IEEE, May 18, 1998, vol. CONF. 48, pp. 1214-1218.

* cited by examiner $a_l$= 0,0
$a_h$= 0,7

$s1_l$= 0,3
$s1_h$= 0,75

METHOD FOR IMPROVING SPEECH QUALITY IN SPEECH TRANSMISSION TASKS

CROSS-REFERENCE TO RELATED APPLICATIONS

This application is a U.S. National Stage Application under 35 U.S.C. § of PCT International Application No. PCT/EP01/02603, filed Mar. 8, 2001, which claims priority to German Patent Application No. DE 100 20 863.0, filed Apr. 28, 2000. Each of these applications is incorporated herein by reference as if set forth in its entirety.

The present invention relates to a method for calculating the amplification factor which co-determines the volume for a speech signal transmitted in encoded form.

In the domain of speech transmission and in the field of digital signal and speech storage, the use of special digital coding methods for data compression purposes is widespread and mandatory because of the high data volume and the limited transmission capacities. A method which is particularly suitable for the transmission of speech is the Code Excited Linear Prediction (CELP) method which is known from U.S. Pat. No. 4,133,976. In this method, the speech signal is encoded and transmitted in small temporal segments ("speech frames", "frames", "temporal section", "temporal segment") having a length of about 5 ms to 50 ms each. Each of these temporal segments is not represented exactly but only by an approximation of the actual signal shape. In this context, the approximation describing the signal segment is essentially obtained from three components which are used to reconstruct the signal on the decoder side: Firstly, a filter approximately describing the spectral structure of the respective signal section; secondly, a so-called "excitation signal" which is filtered by this filter; and thirdly, an amplification factor (gain) by which the excitation signal is multiplied prior to filtering. The amplification factor is responsible for the loudness of the respective segment of the reconstructed signal.

The result of this filtering then represents the approximation of the signal portion to be transmitted. The information on the filter settings and the information on the excitation signal to be used and on the scaling (gain) thereof which describes the volume must be transmitted for each segment. Generally, these parameters are obtained from different code books which are available to the encoder and to the decoder in identical copies so that only the number of the most suitable code book entries has to be transmitted for reconstruction. Thus, when coding a speech signal, these most suitable code book entries are to be determined for each segment, searching all relevant code book entries in all relevant combinations, and selecting the entries which yield the smallest deviation from the original signal in terms of a useful distance measure.

There exist different methods for optimizing the structure of the code books (for example, multiple stages, linear prediction on the basis of the preceding values, specific distance measures, optimized search methods, etc.). Moreover, there are different methods describing the structure and the search method for determining the excitation vectors.

The amplification factor (gain value) can also be determined in different ways in a suitable manner. In principle, the amplification factor can be approximated using two methods which will be described below:

Method 1: "Waveform Matching"

In this method, the amplification factor is calculated while taking into account the waveform of the excitation signal from the code book. For the purpose of calculation, deviation $E_1$ between original signal x (represented as vector), i.e., the signal to be transmitted, and the reconstructed signal g H c is minimized. In this context, g is the amplification factor to be determined, H is the matrix describing the filter operation, and c is the most suitable excitation code book vector which is to be determined as well and has the same dimension as target vector x.

$$E_1=\|x-gHc\|^2$$

Generally, for the purpose of calculation, optimum code book vector c-opt is determined first. After that, amplification factor g which is optimal for this is initially calculated and then, the matching code book vector g-opt is determined. This calculation yields good values every time that the waveform of the excitation code book vector from the code book, which vector is filtered with H, corresponds as far as possible to the input waveform. Generally, this is more frequently the case, for example, with clear speech without background noises than with speech signals including background noises. In the case of strong background noises, therefore, an amplification factor calculation according to method 1 can result in disturbing effects which can manifest themselves, for example, in the form of volume fluctuations.

Method 2: "Energy Matching"

In this method, amplification factor g is calculated without taking into account the waveform of the speech signal. Deviation $E_2$ is minimized in the calculation:

$$E_2=(\|exc\ (g)\|-\|res\ \|)^2$$

In this context, exc is the scaled code book vector which depends on amplification factor g; res designates the "ideal" excitation signal. Moreover, other previously determined constant code book entries d may be added:

$$exc\ (g)=c_opt*g+d$$

This method yields good values, for example, in the case of low-periodicity signals, which may include, for example, speech signals having a high level of background noise. In the case of low background noises, however, the amplification values calculated according to method 2 generally yield values worse than those of method 1.

In the method used today, initially, optimum code book entry g_opt resulting from method 1 is determined and then amplification factor g_opt2, which is quantized, i.e., found in the code book, and which is actually to be used, is determined by minimizing quantity $E_3$.

$$E_3(\text{g_opt2}) = (1-a)*\|\text{c_opt}\|^2*(\text{g_opt2}-\text{g_opt})^2 + a*(\|exc(\text{g_opt2})\| - \|res\|)^2 \quad \text{Equation (1)}$$

In this context, weighting factor a can take values between 0 and 1 and is to be predetermined using suitable algorithms. For the extreme case that a=0, only the first summand is considered in this equation. In this case, the minimization of $E_3$ always leads to g_opt2=g_opt, so that value g_opt, which has previously been calculated according to method 1, is taken over as the result of the final amplification value calculation (pure "waveform matching"). In the other extreme case that a=1, however, only the second summand is considered. In this case, always the same solution then results for g_opt2 as when using method 2 (pure "energy matching"). The value of a will generally be between 0 and 1 and consequently lead to a result value for g_opt2 which takes into account both methods 1 "waveform matching" and 2 "energy matching".

Thus, the degree to which the result of method 1 or the result of method 2 should be used is controlled via weighting factor a. Quantized value gain-eff2, which is calculated according to equation (1) by minimizing $E_3$, is then transmitted and used on the decoder side.

The underlying problem now consists in determining weighting factor a for each signal segment to be encoded in such a manner that the most useful possible values are found through the calculation according to equation (1) or according to another minimization function in which a weighting between two methods is utilized. In terms of the speech quality of the transmission, "useful values" are values which are adapted as well as possible to the signal situation present in the current signal segment. For noise-free speech, for example, a would have to be selected to be near 0, in the case of strong background noises, a would have to be selected to be near 1.

In the methods used today, the value of weighting factor a is controlled via a periodicity measure by using the prediction gain as the basis for the determination of the periodicity of the present signal. The value of a to be used is determined via a fixed characteristic curve f(p) from the periodicity measure data describing the current signal state, the periodicity measure being denoted by p. This characteristic curve is designed in such a manner that it yields a low value for a for highly periodic signals. This means that for highly period signals, preference is given to method 1 of "waveform matching". For signals of lower periodicity, however, a higher value is selected for a, i.e., closer to 1, via f(p).

In practice, however, it has turned out that this method still results in artifacts in the case of certain signals. These include, for example, the beginning of voiced signal portions, so-called "onsets", or also noise signals without periodic components.

SUMMARY OF THE INVENTION

Therefore, an object of the present invention is to provide a method for calculating the amplification factor which co-determines the volume for a speech signal transmitted in encoded form, which method allows an optimum weighting factor a to be determined for the calculation of an optimum amplification factor for a variety of signals.

The present invention provides a method for calculating an amplification factor for co-determining a volume for a speech signal transmitted in encoded form, the amplification factor being transmitted and used by a decoder to reconstruct the speech signal. The method includes: dividing the speech signal into a plurality of short temporal signal segments; encoding and transmitting each signal segment separately from the other signal segments; calculating the amplification factor for each signal segment by minimizing a value E(g_opt2), where $$E(g_opt2)=(1-a)*f_1(g_opt2)+a*f2(g_opt2)$$

a being a weighting factor; and taking into account a stationarity and a periodicity of the encoded speech signal so as to determine the weighting factor a.

In the present invention, the notation $f_1$ and $f_2$ is used to denote generic functions relating to the optimum code book vector c-opt, amplification factor g_opt2, matching code book vector g-opt, excitation code book vector exc, and optimum code book entry g_opt. In the example described above relative to Equation (1), it can be seen that $f_1(g_opt2)=\|c\text{-}opt\|^2 * (g_opt2_g_opt)^2$. Likewise, it can be seen that $f_2(g_opt2)\|(\|exc\ (g_opt2)\|—\|res\|)^2$. It can be appreciated that $f_1$ and $f_2$ are functions which can be selected depending on the desired optimization of the structure of the code books, as should be apparent to those of ordinary skill in the art.

In the method according to the present invention, provision is made to not only use periodicity $S_1$ of the signal but to also use stationarity $S_2$ of the signal for determining the weighting factor. Depending on the quality of weighting factor a to be determined, it is possible for further parameters which are characteristic of the present signals, such as the continuous estimation of the noise level, to be taken into account in the determination of the weighting factor. Therefore, weighting factor a is advantageously determined not only from periodicity $S_1$ but from a plurality of parameters. The number of used parameters or measures will be denoted by N. An improved, more robust determination of a can be accomplished by combining the results of the individual measures. Thus, the value of a to be used is no longer made dependent on one measure only but, via a rule h, it depends on the data of all N measures $S_1, S_2, \ldots S_N$ describing the current signal state. The resulting relationship is shown in equation (2):

$$a=h(S_1, S_2, \ldots S_N) \qquad \text{(equation 2)}$$

Thus, an embodiment of the method according to the present invention uses a periodicity measure $S_1$ and, in addition, a stationarity measure $S_2$. By additionally taking into account stationarity measure $S_2$ of the signal, it is possible to better deal, for example, with the problematic cases (onsets, noise) mentioned above. In this context, in a speech coding system using the method according to the present invention, initially, the results of periodicity measure $S_1$ and, of stationarity measure $S_2$are calculated. Then, the suitable value for weighting factor a is calculated from the two measures according to equation (2). This value is then used in equation (1) to determine the best value for the amplification factor.

A concrete way of implementing the assignment rule $h(S_1)$ is, for example, to use a number K of different characteristic curve shapes $h_1(S_1) \ldots h_k(S_1)$ and to control, via a parameter $S_2$, characteristic curve shape $h_i(S_1)$ which is to be used in the present signal case.

In this context, the following distinctions could be made for K=3:

$$\text{use } a=h_1(S_1), \text{ if } S_{2a}<S_2<=S_{2b},$$

$$\text{use } a=h_2(S_1), \text{ if } S_{2b}<S_2<=S_{2c},$$

$$\text{use } a=h_3(S_1), \text{ if } S_{2c}<S_2<=S_{2d},$$

where $S_{2a}<S_2<S_{2d}$

DETAILED DESCRIPTION

In the following, the method according to the present invention will be explained in greater detail with the example that K=2. In this case, the used assignment rule h(.) provides for two different characteristic curve shapes $h_1(S_1)$ and $h_2(S_1)$. The respective characteristic curve is selected as a function of a further parameter $S_2$ which is either 0 or 1.

Parameter S1 describes the voicedness (periodicity) of the signal. The information on the voicedness results from the knowledge of input signal s(n) (n=0 . . . L, L: length of the observed signal segment) and of the estimate t of the pitch (duration of the fundamental period of the momentary speech segment). Initially, a voiced/unvoiced criterion is to be calculated as follows:

$$\chi = \frac{\sum_{i=0}^{L-1} s(i)\cdot s(i-\tau)}{\sqrt{\sum_{i=0}^{L-1} s^2(i)\cdot \sum_{i=0}^{L-1} s^2(i-\tau)}}$$

The parameter S1 used is now obtained by generating the short-term average value of $\chi$ over the last 10 signal segments ($m_{cur}$: index of the current signal segment):

$$S_1 = \frac{1}{10}\sum_{i=m_{cur}-10}^{m_{cur}} \chi_i.$$

Figure 1:
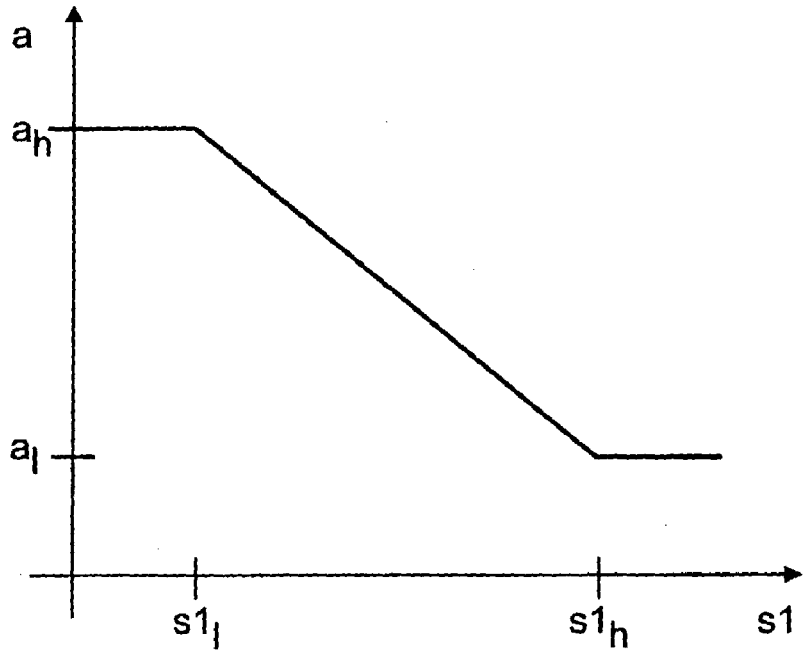
FIG. 1 shows a graphical representation of the dependence of weighting factor a on $S_1$.

FIG. 1 is a schematic representation of the dependence of weighting factor a on $S_1$.

Accordingly, the shape of the characteristic curve depends on the selection of threshold values $a_1$ and $a_h$ as well as $s1_1$ and $s1_h$.

The indicated selection of characteristic curve $h_1$ or $h_2$ as a function of $S_2$ means that different combinations of threshold values ($a_1$, $a_h$, $s1_1$, $s1_h$) are selected for different values of $S_2$.

Parameter $S_2$ contains information on the stationarity of the present signal segment. Specifically, this is status information which indicates whether speech activity (s2=1) or a speech pause ($S_2$=0) is present in the signal segment currently observed. This information must be supplied by an algorithm for detecting speech pauses (VAD=Voice Activity Detection).

Since the recognition of speech pauses and of stationary signal segments are in principle similar, the VAD is not optimized for an exact determination of the speech pauses (as is otherwise usual) but for a classification of signal segments that are considered to be stationary with regard to the determination of the amplification factor.

Since stationarity $S_2$ of a signal is not a clearly defined measurable variable, it will be defined more precisely below.

If, initially, the frequency spectrum of a signal segment is looked at, it has a characteristic shape for the observed period of time. If the change in the frequency spectra of temporally successive signal segments is sufficiently low, i.e., the characteristic shapes of the respective spectra are more or less maintained, then one can speak of spectral stationarity.

If a signal segment is observed in the time domain, then it has an amplitude or energy profile which is characteristic of the observed period of time. If the energy of temporally successive signal segments remains constant or if the deviation of the energy is limited to a sufficiently small tolerance interval, then one can speak of temporal stationarity.

If temporally successive signal segments are both spectrally and temporally stationary, then they are generally described as stationary. The determination of spectral and temporal stationarity is carried out in two separate stages. Initially, the spectral stationarity is analyzed:

Spectral Stationarity (Stage 1)

To determine whether spectral stationarity exists, initially, a spectral distance measure), the so-called "spectral distortion" SD, of successive signal segments is observed.

The resulting calculation is as follows:

$$SD = \sqrt{\frac{1}{2\pi}\int_{-\pi}^{\pi}\left(10\log\left[\frac{1}{|A(e^{j\omega})|^2}\right] - 10\log\left[\frac{1}{|A'(e^{j\omega})|^2}\right]\right)^2 d\omega}$$

In this context, $$10\log\left[\frac{1}{|A(e^{j\omega})|^2}\right]$$

denotes the logarithmized frequency response envelope of the current signal segment, and $$10\log\left[\frac{1}{|A'(e^{j\omega})|^2}\right]$$

denotes the logarithmized frequency response envelope of the preceding signal segment. To make the decision, both SD itself and its short-term average value over the last 10 signal segments are looked at. If both measures SD and are below a threshold value $SD_g$, and $_g$, respectively, which are specific for them, then spectral stationarity is assumed.

Specifically, it applies that $SD_g$=2.6 dB $\overline{SD}_g$=2.6 dB

It is problematic that extremely periodic (voiced) signal segments feature this spectral stationarity as well. They are excluded via periodicity measure s1. It applies that:

If s1≧0.7 or s1<0.3 the observed signal segment is assumed not to be spectrally stationary.

Temporal Stationarity (Stage 2):

The determination of temporal stationarity takes place in a second stage whose decision thresholds depend on the detection of spectrally stationary signal segments of the first stage. If the present signal segment has been classified as spectrally stationary by the first stage, then its frequency response envelope $$\frac{1}{|A(e^{j\omega})|^2}$$

is stored. Also stored is reference energy $E_{reference}$ of residual signal $d_{reference}$ which results from the filtering of the present signal segment with a filter having the frequency response $|A(e^{j\omega})|^2$ which is inverse to this signal segment. $E_{reference}$ results from $$E_{reference} = \sum_{n=0}^{L-1} d_{reference}^2(n)$$

where L corresponds to the length of the observed signal segment.

This energy serves as a reference value until the next spectrally stationary segment is detected. All subsequent signal segments are now filtered with the same stored filter. Now, energy $E_{rest}$ of residual signal $d_{rest}$ which has resulted after the filtering is measured. Accordingly, it is expressed as:

$$E_{rest} = \sum_{n=0}^{L-1} d_{rest}^2(n).$$

Figure 2:
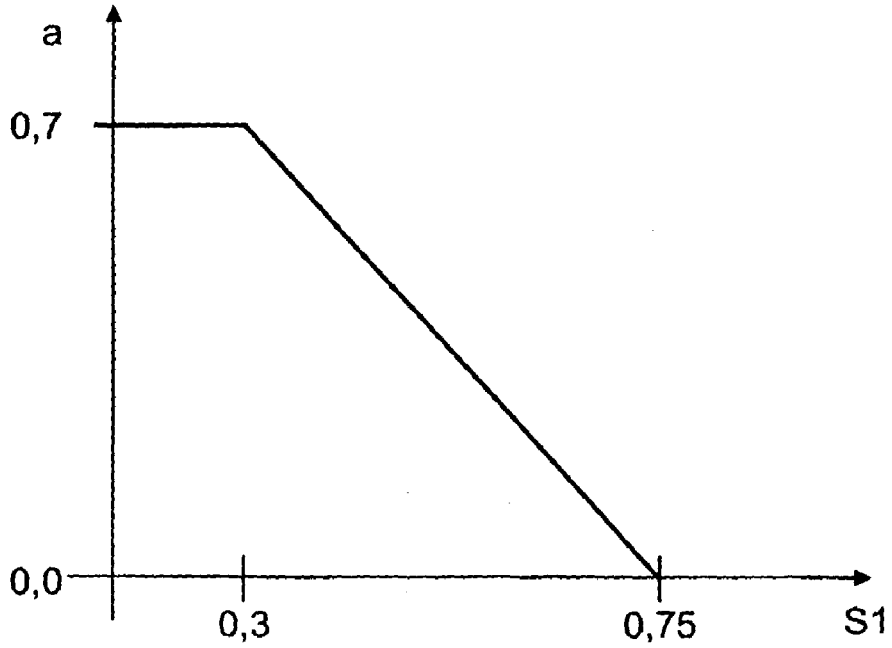
FIG. 2 shows a graphical representation of the relationship between weighting factor a and $S_1$ for the values of $a_1$, $a_h$, $s1_1$, and $s1_h$ indicated.

The final decision of whether the observed signal segment is stationary follows the following rule:

If: $E_{rest} < E_{reference}$+tolerance s2=1, signal stationary, otherwise s=0, signal non-stationary By way of example, the assignment depicted in FIG. 2 applies in this context, where for s2=1 (h1(s1), non-stationary): and s2=0 (h2(s1), stationary/pause)→a=1.0 for all s1

This means that the characteristic curve is flat and that a has the value 1, independently of s1.

It is, of course, also possible to conceive of a dependency in which a continuous parameter $S_2$ ($0 \leqq s2 \leqq 1$) contains information on stationarity $S_2$. In this case, the different characteristic curves $h_1$ and $h_2$ are replaced with a three-dimensional area h(s1, s2) which determines a.

Of course, the algorithms for determining the stationarity and the periodicity must or can be adapted to the specific given circumstances accordingly. The individual threshold values and functions mentioned above are exemplary. The individual threshold values and functions may be found by separate trials.

What is claimed is:

1. A method for calculating an amplification factor for co-determining a volume for a speech signal transmitted in encoded form, the amplification factor being transmitted and used by a decoder to reconstruct the speech signal, the method comprising the steps of:

dividing the speech signal into a plurality of short temporal signal segments;

encoding and transmitting each signal segment separately from the other signal segments;

calculating the amplification factor for each signal segment by minimizing a deviation value E(g_opt2), wherein $E(g_opt2)=(1-a)*f_1(g_opt2)+a*f_2(g_opt2)$ wherein g_opt2 is an amplification factory, $f_1$ represents waveform matching, $f_2$ represents energy matching, and a is a weighting factor; and taking into account a stationarity and a periodicity of the encoded speech signal so as to determine the weighting factor a.

2. The method as recited in claim 1 wherein the minimizing of the value E(g_opt2) is performed using the equation:

$$E_3(g_opt2) = (1-a)*\|c_opt\|^2*(g_opt2-g_opt)^2 + a*(\|exc(g_opt2)\| - \|res\|)^2$$

wherein c_opt is an optimum codebook vector, g_opt is an optimum codebook entry, exc is a scaled codebook vector, and res is an ideal excitation signal.

3. The method as recited in claim 1 wherein the step of taking into account a stationarity and a periodicity of the encoded speech signal is performed by selecting a function $h_1(S1)$ as a function of a value determined for the stationarity of the encoded speech signal, $S_1$ being a measure of the periodicity of the encoded speech signal.

4. The method as recited in claim 3 wherein the stationarity is a measure of speech activity.

5. The method as recited in claim 3 wherein the stationarity is a measure of a ratio of speech level to background noise level of a respective signal segment.

6. The method as recited in claim 1 further comprising the step of calculating the stationarity as a function of a spectral change and an energy change.

7. The method as recited in claim 6 wherein the energy change is a measure of temporal stationarity.

8. The method as recited in claim 6 wherein the step of calculating the stationarity is performed by taking into account at least one temporally preceding signal segment.

9. The method as recited in claim 8 further comprising the step of determining the energy change as a function of the spectral change.

10. A method for determining a weighting factor to be applied in a calculation of an amplification factor for co-determining a volume for a speech signal transmitted in encoded form, the method comprising the steps of:

dividing the speech signal into a plurality of temporal signal segments;

encoding and transmitting each signal segment separately from the other signal segments;

calculating the weighting factor a based on a stationarity and a periodicity of the encoded speech signal; and calculating the amplification factor for each signal segment by minimizing a deviation between an original signal and a reconstructed signal in accordance with the weighting factor a.

11. The method according to claim 10, wherein the step of calculating the weighting factor a comprises the step of:

calculating the periodicity based on the length of a respective temporal signal segment and an estimate of a pitch of the respective temporal signal segment.

12. The method according to claim 11, wherein the step of calculating the periodicity further comprises the step of:

calculating a voiced/unvoiced criterion based on the length of a respective temporal signal segment and an estimate of a pitch of the respective temporal signal segment; and generating a short-term average value of the temporal signal segments.

13. The method according to claim 10, wherein the step of calculating the weighting factor a comprises the step of:

calculating the stationarity of a respective signal segment based on a spectral stationary and a temporal stationarity of the respective signal segment.

14. The method according to claim 13, wherein the step of calculating the stationarity of a respective signal segment comprises the steps of:

determining the spectral distortion of a respective signal segment;

calculating a short-term average value of the spectral distortion over a series of preceding segments; and evaluating if both the spectral distortion of the respective signal segment and the short-term average value of the spectral distortion are below a threshold value to determine spectral stationarity.

15. The method according to claim 13, wherein the step of calculating the weighting factor a comprises the step of:

calculating a temporal stationarity of the respective signal segment if the respective signal segment is determined to be spectrally stationary.

16. The method according to claim 15, wherein the step of calculating a temporal stationarity of the respective signal segment comprises the steps of:

storing a frequency response envelope of the respective signal segment;

filtering the respective signal segment with a filter having an inverse frequency response to that of the respective signal segment;

calculating a reference energy of the respective signal segment;

storing the reference energy of the respective signal segment;

filtering subsequent signal segments to determine an energy of a residual signal; and determining if the respective signal segment is stationary based upon whether the residual signal energy is greater than the reference energy.

17. The method according to claim 10, further comprising the step of:

selecting a respective characteristic curve as a function of the stationarity and the periodicity of the encoded speech signal.

* * * * *